US006435821B1

(12) United States Patent
Nicolson et al.

(10) Patent No.: US 6,435,821 B1
(45) Date of Patent: Aug. 20, 2002

(54) VARIABLE VANE FOR USE IN TURBO MACHINES

(75) Inventors: Matthew Nicolson, Glastonbury; Paul Duesler, Manchester, both of CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 09/742,934

(22) Filed: Dec. 20, 2000

(51) Int. Cl.[7] ..... F01B 25/02

(52) U.S. Cl. ..... 415/161; 415/148; 415/159; 415/162

(58) Field of Search ..... 415/160, 148, 415/159, 161, 162, 229

(56) References Cited

U.S. PATENT DOCUMENTS 5,205,714 A * 4/1993 Shah et al. ..... 416/200

* cited by examiner

*Primary Examiner*—F. Daniel Lopez
*Assistant Examiner*—James M McAleenan
(74) *Attorney, Agent, or Firm*—Bachman & LaPointe, P.C.

(57) ABSTRACT

A vane having a trunnion portion and an airfoil portion is provided with a stress reducing undercut on the trunnion portion proximate to the transition zone defined between the trunnion portion and the airfoil portion of the vane.

14 Claims, 4 Drawing Sheets

VARIABLE VANE FOR USE IN TURBO MACHINES

BACKGROUND OF THE INVENTION

Turbo machines, such as gas turbine engines, have one or more turbine modules, each of which includes a plurality of blades and vanes for exchanging energy with the working medium fluid. Some of the vanes may be fixed and others may be variable, that is, rotatable between positions in the gas turbine engine. A typical vane known in the prior art is shown in FIG. 7 and comprises, generally, a trunnion portion (a) and an airfoil portion (b). The airfoil portion comprises a leading edge (d) and a trailing edge (e). The trunnion portion (a) has an enlarged button portion (f) proximate to a transition zone (g) between the trunnion and airfoil. The variable vane in operation is mounted for rotation about axis (c) so as to locate the position of the leading edge of the airfoil as desired. Generally, the variable vane is rotated through an angle of about 40°.

Because the vanes of a gas turbine engine operate in a hostile environment, they are subjected to significant stresses, both steady stress and vibratory stress. The design of variable vanes of the prior art are such that the transition zone (g) from the trunnion portion (a stiff section of the variable vane) to the airfoil portion of the vane (a flexible section of the variable vane) is subjected to high stresses which may lead to failure of the vane at the transition area and subsequent catastrophic damage to the gas turbine engine.

Naturally, it would be highly desirable to provide a vane configuration which would reduce stress in the transition zone between the stiff portion (the trunnion) and the flexible portion (the airfoil) and provide a substantially smooth and continuous reduction in stress at the transition zone from the trunnion portion to the airfoil portion.

Accordingly, it is a principal object of the present invention to provide a vane which has reduced stress at the transition zone between the stiff section (trunnion) of the variable vane and the flexible section (airfoil) of the vane.

It is a further object of the present invention to provide in the transition zone of a variable vane a smooth and continuous reduction in stress from the stiff (trunnion) portion to the flexible (airfoil) portion of the variable vane.

It is a still further object of the present invention to provide a variable vane useful in gas turbine engines which may be casted.

SUMMARY OF THE INVENTION

According to the invention, the vane is provided with a stress reducing undercut on the stiff portion (trunnion portion) of the vane approximate to the transition zone between the stiff portion and the flexible portion (airfoil portion) of the vane. The undercut reduces stress in the area of the transition zone between the stiff and flexible portions of the vane. The actual vane design is determined by the function of the vane in the engine. Consequently, the stress reducing undercut geometry is such as to optimize the stress reduction in the transition zone for any particular vane design and function in a gas turbine engine. Accordingly, the width, radius of curvature, depth, location from the transition zone and sidewall angles of the stress reducing undercut is parametrically adjusted so as to minimize stress at the transition zone between the stiff section and the flexible section of the vane. According to the present invention, a plurality of stress reducing undercuts may be provided on the stiff section of the vane proximate to the transition zone defined by the junction of the stiff section and the flexible section. If the vane is provided with trunnion portions on either side of the airfoil, stress reducing undercuts may be provided on one or both trunnion portions of the vane in an area proximate to the respective transition zones between the trunnion portions and the airfoil. In addition, one or more enlarged portions (buttons) may be provided on one or more of the trunnions adjacent the transition zones for receiving the undercuts.

The design of the vane in accordance with the present invention offers a number of benefits. Firstly, the provision of stress reducing undercuts, which allow for smooth and continuous reduction in stress at the transition zones of the vane, greatly reduces the need for thickened airfoils which are typically used to reduce the stresses at the transition zones. Thus, there is a weight savings in the vane design. Secondly, the design allows for the vane to be cast rather than forged as is currently the case which results in substantial cost savings in manufacture.

BRIEF DESCRIPTION OF THE DRAWINGS

The foregoing features and advantages of the vane of the present invention will become more apparent in light of the following description of the best mode for carrying out the invention and the accompanying drawings.

DETAILED DESCRIPTION OF PREFERRED EMBODIMENTS

Figure 1:
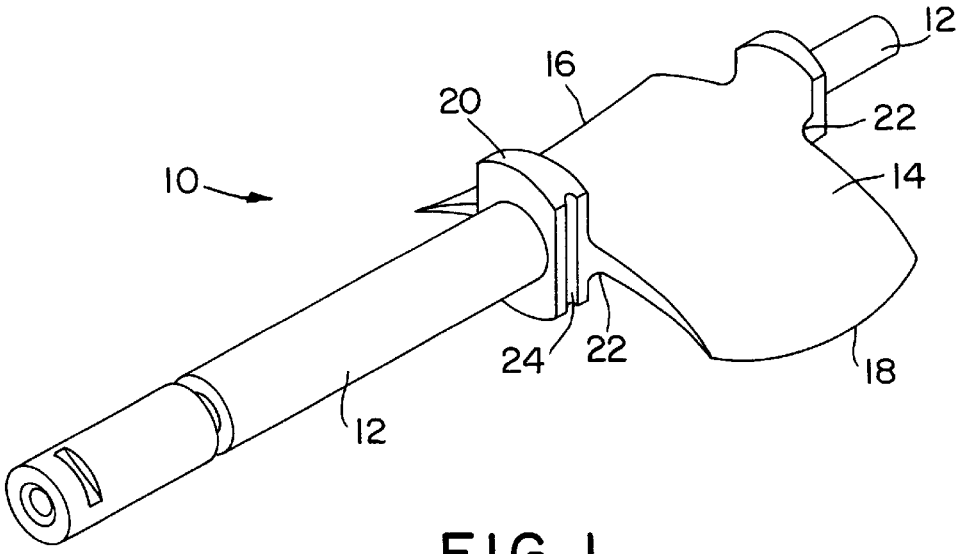
FIG. 1 is a perspective of a vane design in accordance with the present invention.
Figure 7:
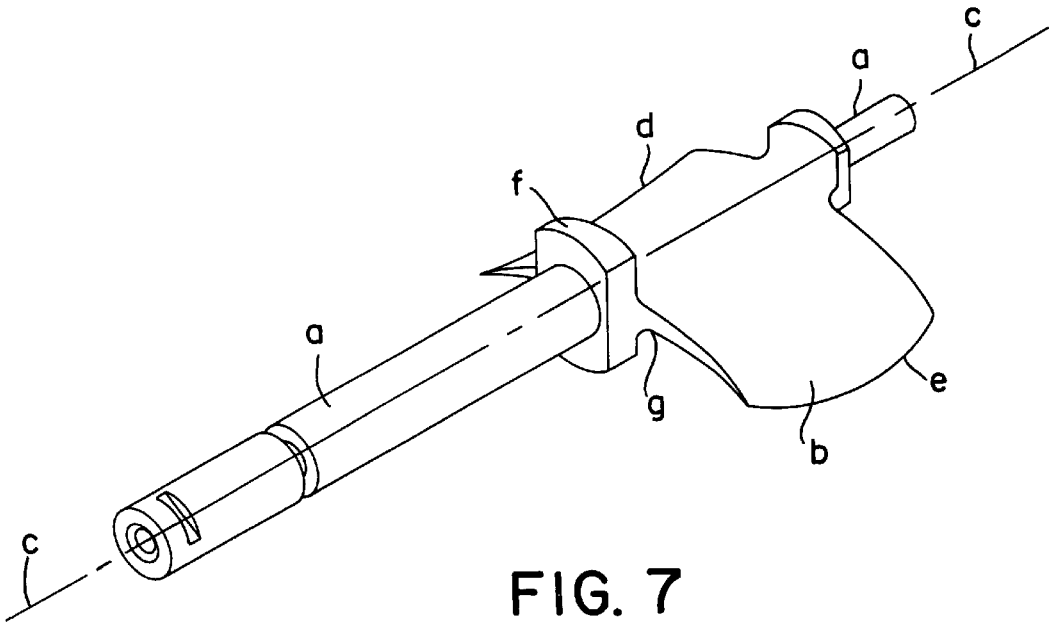
FIG. 7 (PRIOR ART)
FIG. 7 illustrates a vane design known in the prior art.

The vane design of FIG. 1 is an improvement over the prior art vane design illustrated in FIG. 7. Vane 10 of FIG. 1 includes a trunnion portion 12 and an airfoil portion 14. The airfoil portion 14 has a leading edge 16 and a trailing edge 18. The trunnion portion further includes an enlarged button portion 20 on one or both sides of the airfoil 14 proximate to the transition zones 22 between the trunnion portion and the airfoil portion.

Figure 6:
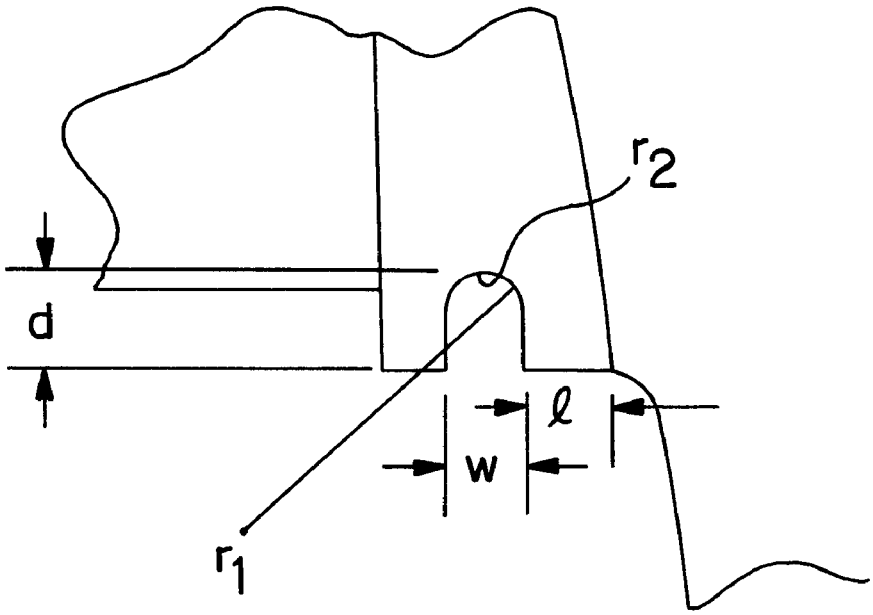
FIG. 6 is an enlarged view of the stress reducing undercut in accordance with the invention.

In accordance with the present invention, the trunnion portion 12 is provided with at least one stress reducing undercut 24 on the trunnion portion proximate to at least one of the transition zones 22. It has been found, in accordance with the present invention, that providing a stress reducing undercut proximate to a transition zone, a substantially smooth and continuous reduction in stress is realized across the transition zone from the trunnion portion of the vane to the airfoil portion of the vane. The stress reducing undercut geometry is such as to optimize the stress reduction in a substantially smooth and continuous manner in the transition zone for a particular vane design and function in a gas turbine engine. Accordingly, with reference to FIG. 6, the width w, radius of curvature from the sidewall, to the bottom wall $r_1$ and of the bottom wall $r_2$, the depth d, the location l relative to the transition zones, and the sidewall angles $\alpha$ of the stress reducing undercut are parametrically adjusted so as to minimize stress at the transition zone between the stiff section (the trunnion portion) and the flexible section (the airfoil portion) of the vane. It is critical in accordance with the present invention, that the bottom wall of the stress reducing undercut have a radius of curvature $r_2$ and that the transition from the sidewalls of the undercut to the bottom wall also exhibit a radius of curvature $r_1$. A sharp angle from the sidewalls to the bottom wall of the undercut groove would result in stress concentrations which would be undesirable.

Figure 2:
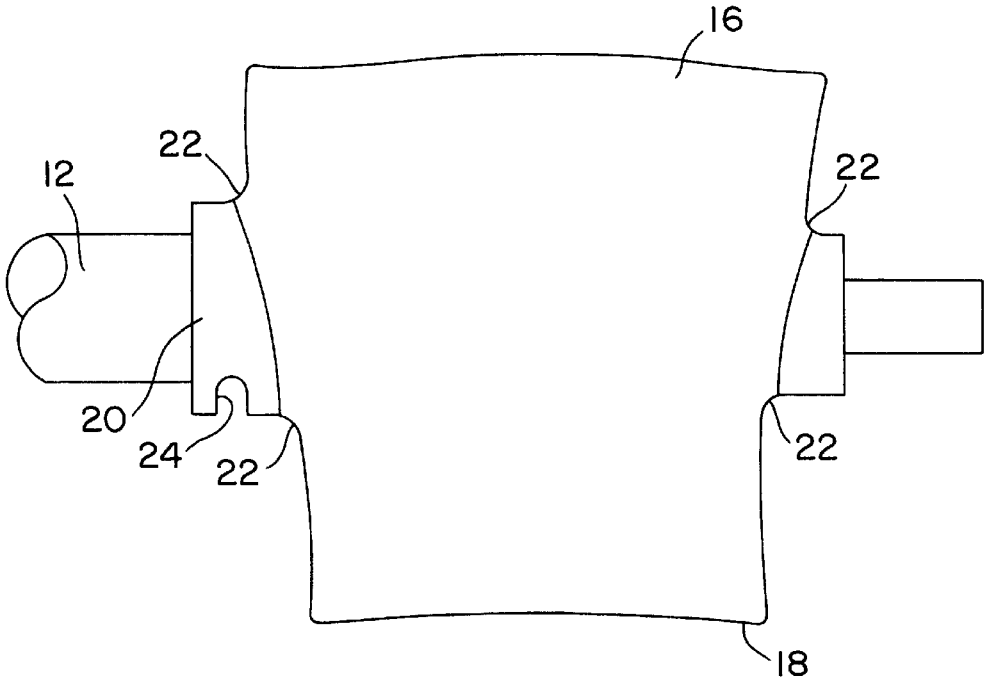
FIG. 2 is a partial top view of the vane design of FIG. 1.
Figure 3:
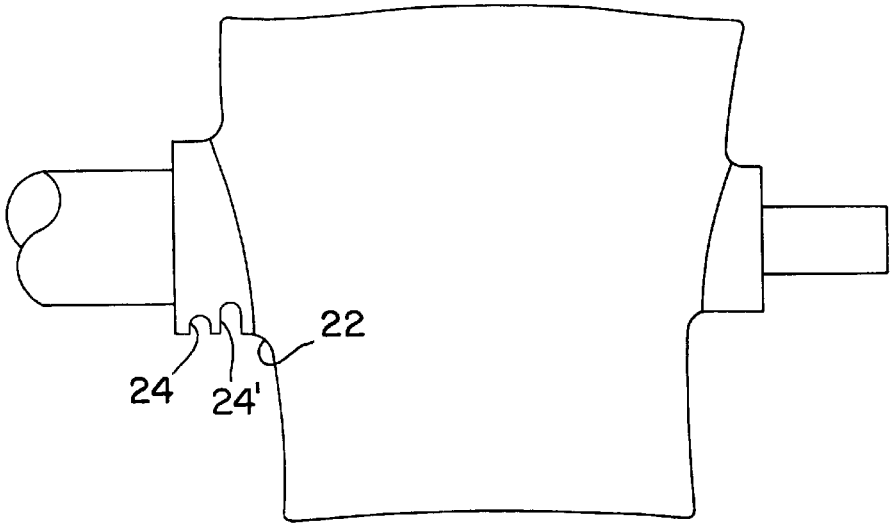
FIG. 3 is a partial top view of a second embodiment of a vane design in accordance with the present invention.

In accordance with a further embodiment of the present invention as illustrated in FIG. 3, a plurality of stress reducing undercuts 24, 24' may be required, depending on vane defining function, in order to provide the substantial smooth and continuous reduction in stress at the transition zone. As can be seen in FIG. 3, it has been found that when a plurality of stress reducing undercuts are provided adjacent to each other, the undercuts are preferably of different depth and arranged serially on the trunnion portion with the first undercut 24' of a depth greater than the second undercut 24 being located between the second undercut 24 and the transition zone 22 as shown in FIG. 3. The arrangement of the plurality of stress reducing undercuts as illustrated in FIG. 3 is effective for some vane design geometries. Again, depending on the particular vane design and function in a turbo machine, the number of stress reducing undercuts and their geometry, vis-à-vis with radius', depths, locations and sidewall angles are such as to minimize stress at the transition zones 22. Although not illustrated, it should be appreciated that stress reducing undercuts may be provided on both sides of the airfoil illustrated in FIGS. 1–3 proximate to the respective transition-zones.

Figure 4:
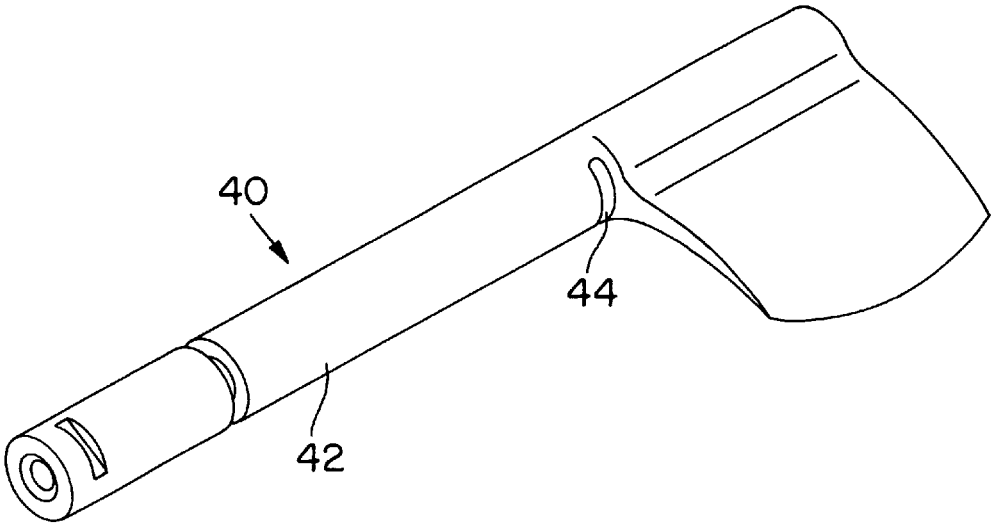
FIG. 4 is a perspective view of a third embodiment of a vane design of the present invention.
Figure 5:
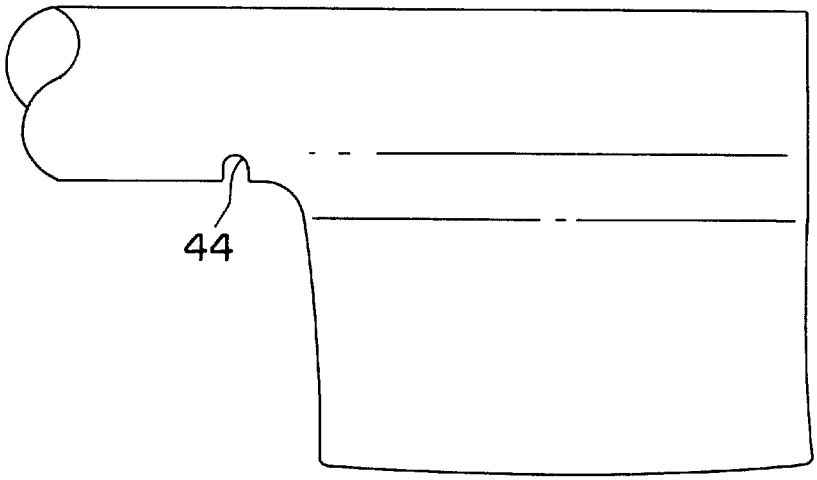
FIG. 5 is a partial top view of the vane design of FIG. 4.

FIGS. 4 and 5 illustrate a second embodiment of vane design in accordance with the present invention. As can be seen from FIGS. 4 and 5, a stress reducing undercut 44 is provided on the trunnion portion 44 to proximate to the transition zone 42 between the trunnion portion 44 and the airfoil portion 46 of the vane 40. The vane design of FIGS. 4 and 5 does not include an enlarged button portion as illustrated in FIGS. 1–3.

While the location of the undercut groove with respect to its distance from the transition zone may vary, as noted above, based on the particular vane design and function of the vane in a turbo machine, it is critical that the stress reducing undercut be located on the trunnion portion at a location remote from the leading edge of the airfoil and sized so as to ensure that the stress reducing undercut not be exposed to the air passing over the airfoil as the variable vane is rotated through the operational angle of between 30 to 50°. The foregoing is critical so as to ensure proper operation of the vanes by avoiding a preferential path of air flow from the leading edge through the stress reducing undercut. Accordingly, the stress reducing undercut is located closer to the trailing edge of the airfoil then the leading edge on the trunnion portion.

The design of the vane in accordance with the present invention offers a number of benefits. Firstly, the provision of a stress reduced undercut which allows for a smooth and continuous reduction in stress across the transition zone of the vane between the trunnion portion and the airfoil portion, greatly reduces the need for thickened airfoils which are typically used to reduce stresses at the transition zones in the prior art vane design. Accordingly, the life of the vane is greatly increased and the likelihood of catastrophic failure is decreased. By avoiding a thickened airfoil, there is an overall weight savings in the vane design of the present invention which is desirable. Secondly, the vane design of the present invention allows for the vane to be cast rather than forged as is currently required in the prior art. The castings are far less costly than forgings, and, consequently, substantial cost savings in manufacturing of the vane are realized.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A vane comprising:

trunnion portion;

an airfoil portion fixed to the trunnion portion at a location defining a transition zone; and a stress reducing undercut on the trunnion portion and proximate to the transition zone so as to provide a substantially smooth and continuous reduction in stress at the transition zone from the trunnion portion to the airfoil portion.

2. A vane design according to claim 1 wherein the trunnion portion includes a shaft portion and an enlarged button portion, wherein the button portion is proximate to the transition zone, the stress reducing undercut being located on the button portion.

3. A vane design according to claim 1 wherein the airfoil has a leading edge and a trailing edge and the stress reducing undercut is located closer to the trailing edge than the leading edge.

4. A vane design according to claim 2 wherein the airfoil has a leading edge and a trailing edge and the stress reducing undercut is located closer to the trailing edge than the leading edge.

5. A vane design according to claim 1 wherein the stress reducing undercut is a groove defined by sidewalls and a bottom wall connected to the sidewalls by arcuate transitions having a radius of curvature.

6. A vane design according to claim 5 wherein the bottom wall has a radius of curvature.

7. A vane design according to claim 6 wherein the sidewalls are substantially parallel.

8. A vane design according to claim 6 wherein the sidewalls radiate from the bottom wall in a diverging manner to form an angle.

9. A vane design according to claim 1 wherein the vane is used in a turbomachine.

10. A vane design according to claim 1 wherein the vane is used in a gas turbine engine.

11. A vane design according to claim 1 wherein the trunnion portion is provided with a plurality of stress reducing undercuts.

12. A vane design according to claim 11 wherein the plurality of stress reducing undercuts comprises at least two undercuts of different depth arranged serially on the trunnion portion.

13. A vane design according to claim 12 wherein the first undercut is of a depth greater than the second undercut and the first undercut is between the second undercut and the transition zone.

14. A vane design according to claim 1 wherein the vane is formed by casting metal.

* * * * *